US006197385B1

(12) United States Patent
Takeshita et al.

(10) Patent No.: US 6,197,385 B1
(45) Date of Patent: Mar. 6, 2001

(54) FILM FORMING APPARATUS, SUBSTRATE CONVEYING APPARATUS, FILM FORMING METHOD, AND SUBSTRATE CONVEYING METHOD

(75) Inventors: Kazuhiro Takeshita, Kumamoto; Shinji Nagashima, Kikuchi-gun; Yoji Mizutani, Kawasaki, all of (JP)

(73) Assignee: Tokyo Electron Limited, Tokyo-to (JP)

( * ) Notice: Subject to any disclaimer, the term of this patent is extended or adjusted under 35 U.S.C. 154(b) by 0 days.

(21) Appl. No.: 09/243,120

(22) Filed: Feb. 3, 1999

(30) Foreign Application Priority Data

Feb. 4, 1998 (JP) ..... 10-038148
Feb. 13, 1998 (JP) ..... 10-048883

(51) Int. Cl.[7] ..... B05D 3/12; B05C 13/00

(52) U.S. Cl. ..... 427/425; 427/240; 118/52; 118/320; 118/503

(58) Field of Search ..... 414/940, 941, 414/937; 427/240, 425, 421; 118/320, 52, 500, 503

(56) References Cited

U.S. PATENT DOCUMENTS 5,571,560 * 11/1996 Lin ..... 427/240
5,672,205 * 9/1997 Fujimoto et al. ..... 118/52
5,807,607 * 9/1998 Smith et al. ..... 427/96
5,858,462 * 1/1999 Yamazaki ..... 427/226
6,001,416 * 12/1999 Moriyama et al. ..... 427/100
6,001,418 * 12/1999 DeSimone et al. ..... 427/240

FOREIGN PATENT DOCUMENTS 8-255750 10/1996 (JP) .

* cited by examiner

*Primary Examiner*—Shrive Beck
*Assistant Examiner*—Jennifer Calcagni
(74) *Attorney, Agent, or Firm*—Oblon, Spivak, McClelland, Maier & Neustadt, P.C.

(57) ABSTRACT

A coating unit, an aging unit, and a solvent substituting unit are adjacently disposed. The waiting time period after a wafer is loaded to the coating unit until the coating process of the coating process is started, is adjusted so that the staying time period of the wafer in the coating unit becomes longer than the staying time period of the wafer in the aging unit and the staying time period of the wafer in the solvent substituting unit (whichever longer). The staying time period of the wafer in the coating unit is designated as a rate determiner. Thus, after the coating solution is coated to the wafer, the wafer is quickly conveyed to the next process. Consequently, since the solvent can be suppressed from evaporating, an excellent thin film can be obtained.

15 Claims, 16 Drawing Sheets

FILM FORMING APPARATUS, SUBSTRATE CONVEYING APPARATUS, FILM FORMING METHOD, AND SUBSTRATE CONVEYING METHOD

BACKGROUND OF THE INVENTION

1. Field of the Invention

The present invention relates to an apparatus and a method for coating a coating solution on for example a substrate and forming a soft silicon film.

2. Description of the Related Art

As a method for forming an inter-layer insulation film of a semiconductor device, CVD method and heat oxidizing method are known. In addition, sol-gel method is known. In the sol-gel method, coating solution of which colloid of TEOS (tetraethoxysilane: $Si(C_2H_5O)_4$) has been dispersed in organic solvent such as ethanol solvent is coated on the front surface of a semiconductor wafer (hereinafter simply referred to as wafer). The coated film is gelated and dried. Thus, a silicon oxide film is obtained. This method has been disclosed in for example Japanese Patent Laid-Open Publication Nos. 8-162450 and 8-59362.

FIGS. 19A to 19C show states of denaturation of the coated film in the sol-gel method. When the coating solution is coated on the wafer, particles or colloid 100 of TEOS is dispersed in solvent 200 (see FIG. 19A). Thereafter, the coated film is exposed to alkali atmosphere. Thus, since TEOS is poly-condensed and hydrolyzed, the coated film is gelated and thereby a mesh structure of TEOS 300 is formed (see FIG. 19B). Thereafter, solvent contained in the coated film is substituted with another solvent 400 so as to remove moisture of the coating solution (see FIG. 19C). The coated film is dried. Thus, a soft silicon film is obtained as the coated film. In the solvent substituting process shown in FIG. 19C, in addition to removing moisture, with solvent whose surface tension is smaller than that of ethanol, large force is prevented from being applied to the mesh structure of TEOS. Thus, the structure of the film can be prevented from breaking.

When such sol-gel method is applied for a real fabrication line, a coating unit that coats a coating solution to a wafer, a gelating unit that gelates the coated film, and a solvent substituting unit that substitutes solvent contained in the coated film with another solvent are required. In addition, a pre-process unit that performs a preprocess such as a hydrophobic process for a wafer and a baking unit that dries the wafer are required. Moreover, a conveying mechanism that conveys a wafer among these units is required.

After coating solution is coated on a wafer, solvent should be suppressed from evaporating so as to prevent the thickness of the resultant film from decreasing. In addition, after TEOS is gelated until the solvent substituting step is preformed, the solvent should be suppressed from evaporating so as to prevent strong force from being applied to the mesh structure of TEOS.

However, the process time period varies unit by unit. In addition, the process time period also varies corresponding to the unit structure. In other words, in the case that many wafers conveyed with a cassette are successively processed, when a wafer that has been processed in a particular unit is converted to another unit, a waiting time period is required. F or example, a wafer that has been processed in the coating unit may not be converted to the gelating unit, but stayed in the coating unit. Alternatively, a wafer that has been processed in the gelating unit may not be converted to the solvent substituting unit, but stayed in the gelating unit. When such a waiting time period takes place, the solvent on the wafer evaporates. Thus, the film quality deteriorates.

In addition, when a wafer is conveyed from one unit to another unit, the wafer is exposed to air. Thus, when a wafer that has been processed in the coating unit is conveyed to the gelating unit, the solvent on the front surface of the wafer evaporates and thereby the film quality deteriorates.

SUMMARY OF THE INVENTION

The present invention is made from the above-described point of view.

Therefore, an object of the present invention is to provide an apparatus and a method for coating a coating solution of which colloid or particles of a starting substance of a film forming component has been dispersed in solvent to a substrate and for quickly conveying the resultant substrate to the next process so as to obtain an excellent thin film (for example, an inter-layer insulation film).

Another object of the present invention is to provide an apparatus and a method that suppress solvent from evaporating from the front surface of a substrate on which coating solution of which a starting substance of a film forming component has been dispersed in solvent is coated in the case that the substrate is conveyed to the next process so as to obtain an excellent thin film (for example, an interlayer insulation film).

A first aspect of the present invention is an apparatus for forming a film on the front surface of a substrate, comprising a coating portion for coating a coating solution of which particles or collide of a starting substance of a film forming component has been dispersed in first solvent to the front surface of the substrate so as to form a coated film, at least one gelating process portion for gelating particles or collide of the coated film, and a conveying means for loading the substrate to the coating portion, conveying the substrate to the gelating process portion, and unloading the substrate from the gelating process portion, wherein the coating portion causes the substrate to be stayed for a time period adjusted in accordance with a time period after the substrate is loaded from the conveying means to the gelating process portion until the substrate is unloaded from the gelating process portion to the conveying means.

According to the present invention, the staying time period in the coating portion is a rate determiner in the process sequence until the wafer is unloaded from the gelating portion, after the coating solution is coated to the substrate, the substrate is quickly conveyed to the next process. Thus, since the solvent is suppressed from evaporating from the substrate, an excellent thin film can be obtained.

A second aspect of the present invention is an apparatus for conveying a substrate having a coated film of which a coating film containing a starting substance of a film component and solvent has been coated, comprising a substrate conveying member for holding and conveying the substrate, and a vapor supplying means for supplying vapor of the component of the solvent to the front surface of the coated film so as to suppress the solvent contained in the coated film from evaporating.

According to the present invention, when the substrate that has been coated in the coating portion is conveyed to for example the gelating portion by the substrate conveying member, since vapor of a component of the solvent for example ethylene glycol is supplied to the front surface of the coated film, the solvent can be suppressed from evaporating. Thus, an excellent thin film can be obtained.

These and other objects, features and advantages of the present invention will become more apparent in light of the following detailed description of a best mode embodiment thereof, as illustrated in the accompanying drawings.

DETAILED DESCRIPTION OF THE PREFERRED EMBODIMENTS

Figure 1:
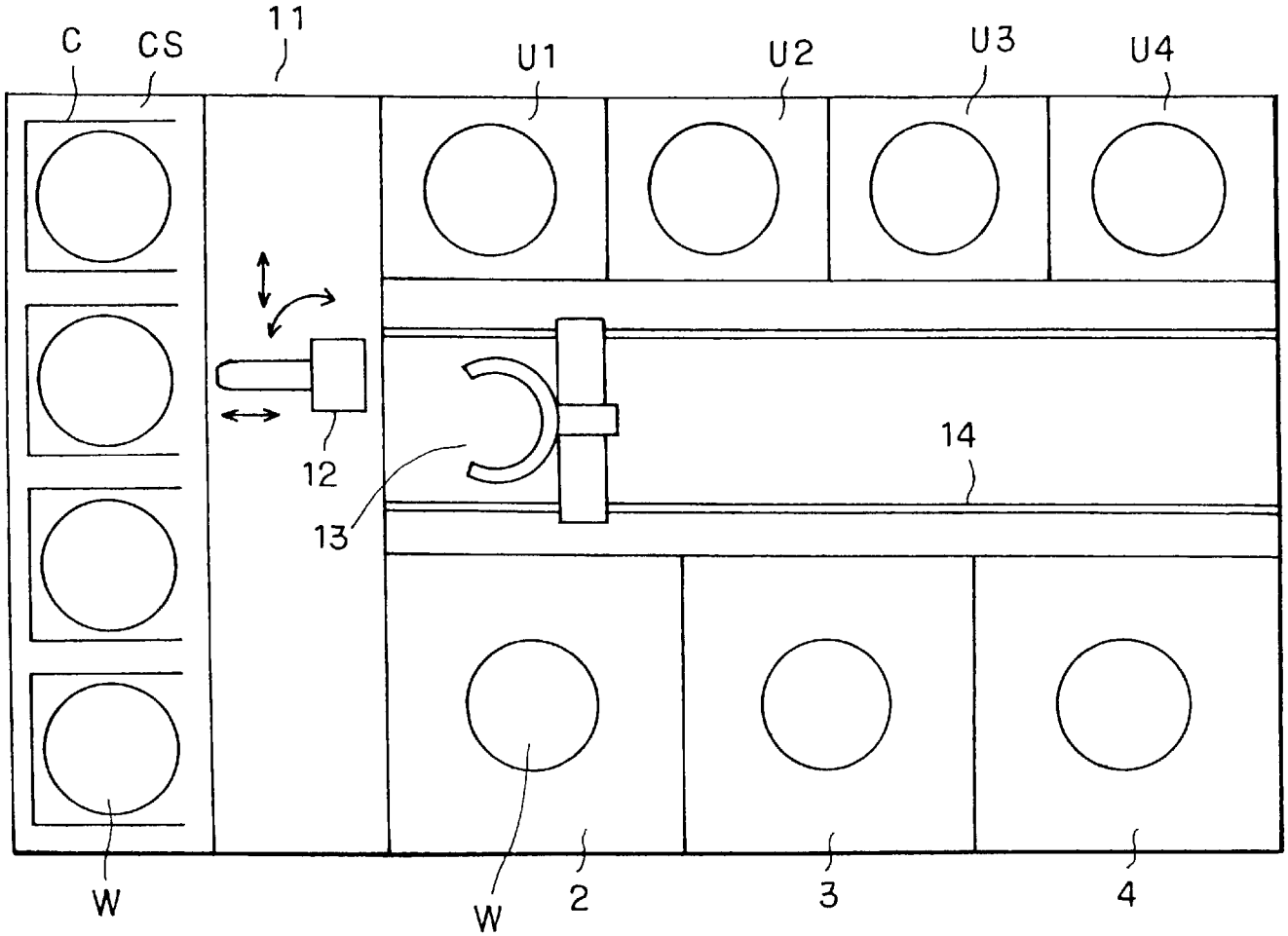
FIG. 1 is a plan view showing an outlined structure of a coated film forming apparatus according to an embodiment of the present invention.

FIG. 1 is a plan view showing an outlined structure of a coated film forming apparatus according to an embodiment of the present invention.

In FIG. 1, reference numeral 11 represents an input/output port for a wafer that is a substrate. A transferring arm 12 extracts a wafer W from a cassette C placed on a cassette stage CS and transfers the wafer W to a main arm 13. On one side of a conveying path (guide rail) 14 of the main arm 13, a coating unit 2 (that is a principal portion of the embodiment), an aging unit 3, and a solvent substituting unit 4 are arranged in the order. The coating unit 2 is a coating portion. The aging unit 3 is a gelating process portion. The solvent substituting unit 4 is a solvent substituting process portion. On the other side of the conveying path 14, process units U1 to U4 are arranged. The process units U1 to U4 perform a hydrophobic process, a cooling process, a heating process (baking process), and so forth.

Next, with reference to FIG. 2, the structure of the coating unit 2 will be described. The coating unit 2 comprises a cup 22, a rotating shaft 24, a vacuum chuck 25, and a coating solution nozzle 26. The cup 22 has a lid 21. The upper portion of the cup 22 is closed with the lid 21. The rotating shaft 24 is inserted from the bottom surface of the cup 22. The rotating shaft 24 is raised/lowered and rotated by a driving portion 23. The vacuum check 25 is disposed at the upper edge of the rotating shaft 24. The vacuum check 25 is a wafer holding portion. The coating solution nozzle 26 is integrated with the lid 21. The coating solution nozzle 26 supplies coating solution to a center portion of the wafer W. A solvent stream supplying pipe (solvent vapor supplying pipe) 27 is connected to the cup 22. The solvent steam supplying pipe 27 supplies steam of solvent from a solvent stream source 27*a* to the cup 22. In addition, a draining pipe 28 and an exhausting pipe 29 are connected to the cup 22.

Figure 2:
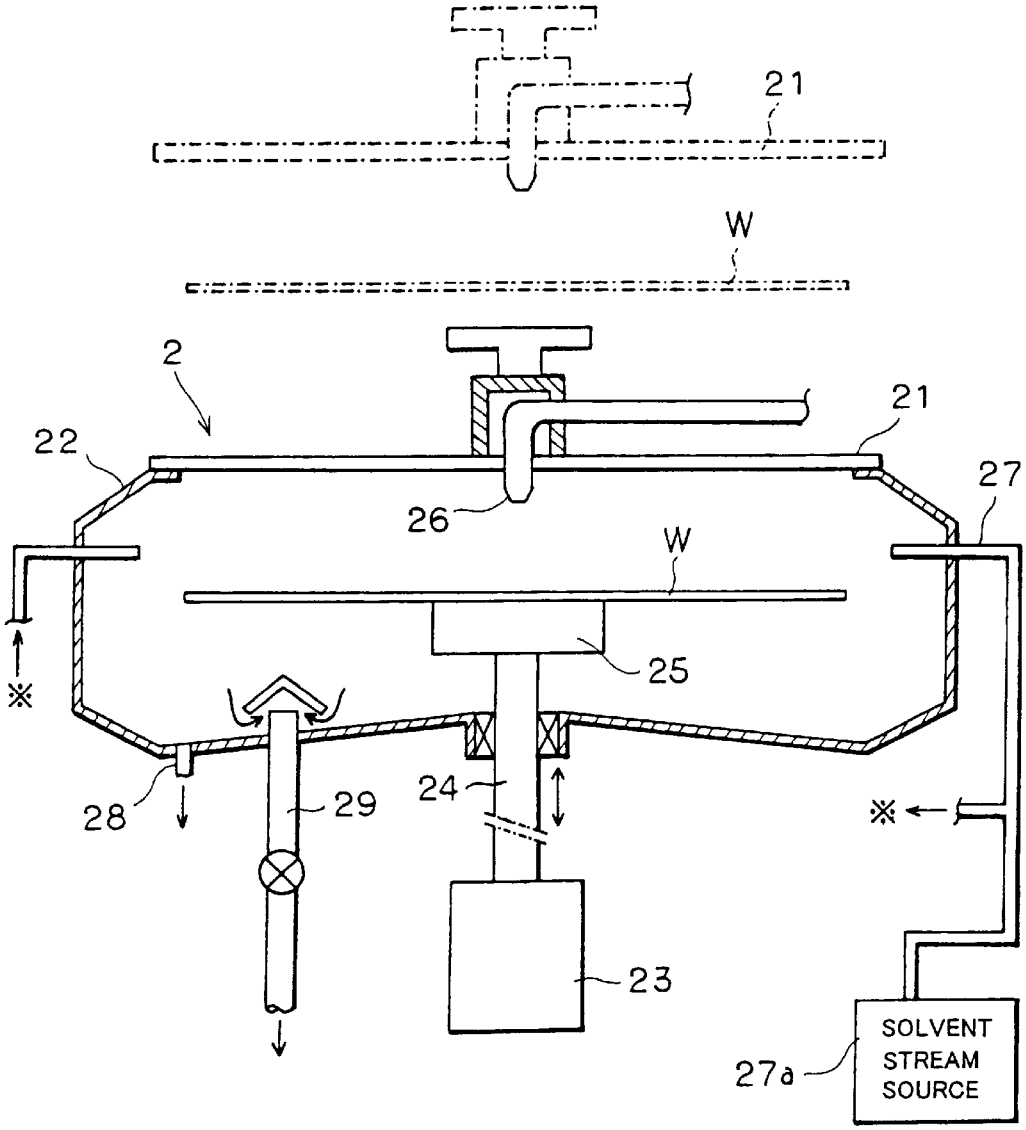
FIG. 2 is a vertical sectional view showing a coating unit according to the embodiment of the present invention.

The wafer W that has been conveyed to the coating unit 2 by the main arm 13 is transferred to the chuck 25 (denoted by a dashed line shown in FIG. 2). After the chuck 25 is lowered, the cup 22 is securely closed with the lid 21. The coating solution is a solution of which colloid or particles of TEOS that is metal alkoxide has been dispersed in a solvent that contains an organic solvent (such as ethylene glycol or ethyl alcohol), a water, and small amount of hydrochloric acid. Ethylene glycol allows the viscosity of the coating solution to be properly adjusted when the coating solution is coated. Since the vapor pressure of ethyl alcohol is low in the post-coating process, most of it evaporates. Thus, ethylene glycol remains as solvent and thereby suppresses ethyl alcohol from evaporating.

In this example, the cup 22 is exhausted from the exhausting pipe 29. At this point, a steam (vapor) of ethylene glycol is supplied from the solvent stream supplying pipe 27. After the cup 22 is filled with the stream, the exhausting operation is stopped. Thereafter, the coating solution is supplied from the nozzle 26 to the center portion of the wafer W. Next, the wafer W is rotated by the chuck 25. Thus, the coating solution spreads out on the front surface of the wafer W due to centrifugal force. Consequently, a coated film is formed. Thereafter, solvent is sprayed from a nozzle (not shown) in the cup 22 to the periphery of the wafer W. Thus, the coated film on the periphery of the wafer W is removed.

Thereafter, in the state that the lid 21 is slightly raised, the cup 22 exhausted. Next, the lid 21 and the chuck 25 are raised. The wafer W is transferred from the chuck 25 to a sub arm (that will be described later). When the cup 22 is filled with steam of ethylene glycol, the solvent contained in the coating solution can be suppressed from evaporating.

Figure 3:
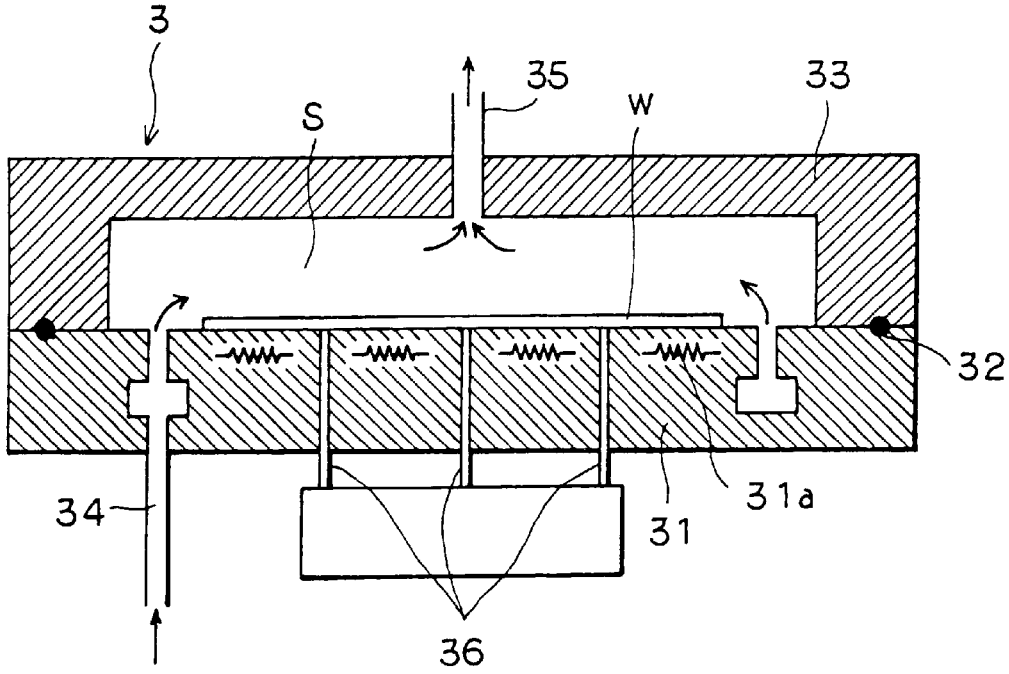
FIG. 3 is a vertical sectional view showing an aging unit according to the embodiment of the present invention.

Next, with reference to FIG. 3, the structure of the aging unit (gelating process portion) 3 will be described. The aging unit 3 comprises a heating plate 31, a lid 33, a gas supplying path 34, an exhausting path 35, and three rising pins 36. The heating plate 31 is composed of ceramics. The heating plate 31 has an inner heater 31*a*. The lid 33 contacts the heating plate 31 through a sealing member 32 disposed on the periphery of the heating plate 31 so as to form a space S as a process chamber above the heating plate 31. The gas supplying path 34 has gas supplying openings on the front surface of the heating plate 31 in such a manner that the gas supplying openings surround the wafer W placed on the heating plate 31. The exhausting path 35 has a sucking opening disposed at a center portion of the lid 33. The three rising pins 36 raise and lower the wafer W between the heating plate 31 and an upper position thereof. A heater is preferably disposed in the lid 33.

In the aging unit 3, after the wafer W is placed on the heating plate 31, the aging unit 3 is closed with the lid 33. A steam of ethylene glycol is supplied from the gas supplying path 34 to the process chamber, and then the steam in the process chamber is exhausted through the exhausting path 35. At this point, the wafer W is heated at for example 100° C. By a process performed in the aging unit 3, colloid of TEOS contained in the coated film on the wafer W is gelated so as to link the colloid in a mesh shape. To do that, the coated film is heated. In this case, as alkali catalyst, ammonium gas may be supplied to the aging unit 3 so as to acceleratingly gelate TEOS. In addition, a steam of ethylene glycol is supplied to the process chamber so as to suppress solvent contained in the coated film from evaporating. Thus, the temperatures of the pipes and stream source are adjusted so that stream of 100 RH % of ethylene glycol takes place at a temperature of the process chamber S.

Figure 4:
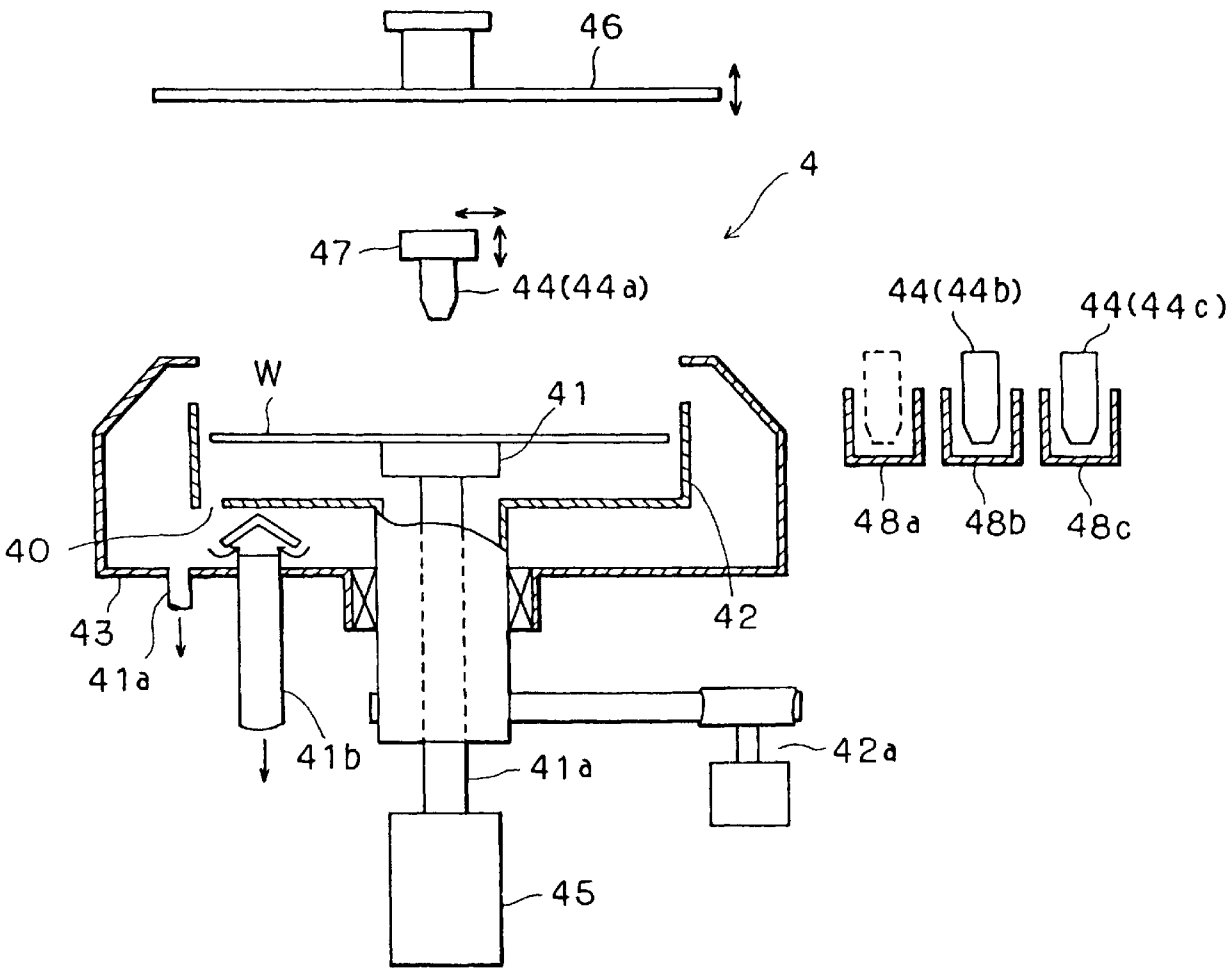
FIG. 4 is a vertical sectional view showing a solvent substituting unit according to the embodiment of the present invention.

Next, with reference to FIG. 4, the structure of the solvent substituting unit 4 will be described. The solvent substituting unit 4 comprises a vacuum chuck 41, a rotating cup 42, a fixed cup 43, and a nozzle 44. The vacuum check 41 horizontally holds and rotates the wafer W. The rotating cup 42 surrounds the wafer W placed on the chuck 41 and has a draining hole 40. The fixed cup 43 is disposed outside the rotating cup 42. A draining path 41*a* and an exhausting path 41*b* are connected to the fixed cup 43. The nozzle 44 supplies a solvent to the wafer W. Reference numeral 45 is a driving portion that rotates and raises/lowers a rotating shaft 41*a*' of the chuck 41. Reference numeral 42*a* is a driving portion that rotates the rotating cup 42.

The fixed cup 43 has an upper opening portion. The opening portion is closed with a lid 46 that is raised and lowered. There are three nozzles 44*a*, 44*b*, and 44*c* that spray ethanol, HMDS (hexamethyldisilane), and heptane to the center portion of the wafer W. The nozzles 44*a*, 44*b*, and 44*c* are extracted from nozzle holding portions 48*a*, 48*b*, and 48*c*, respectively, by a transferring arm 47.

In reality, while the lid 46 is being separated from the opening portion of the fixed cup 43, the chuck 41 receives the wafer W from a sub arm (that will be described later) at an upper position of the fixed cup 43. After the chuck 41 is lowered, while the wafer W and the rotating cup 42 are being rotated, ethanol is supplied from the nozzle 44*a* to front surface of the wafer W. The supplied ethanol spreads out on the entire front surface of the wafer W due to centrifugal force. Thus, ethanol dissolves in moisture contained in the coated film. Consequently, moisture is substituted with ethanol. Thereafter, the lid 46 is separated from the opening portion of the fixed cup 43. Likewise, HMDS is supplied to the front surface of the wafer W. Thus, hydroxyl group is removed from the coated film. Thereafter, heptane is supplied to the front surface of the wafer W. Thus, the solvent contained in the coated film is substituted with heptane. Since the surface tension of heptane is small, force applied to the mesh structure of TEOS becomes small. Thus, the mesh structure of TEOS can be prevented from breaking.

In the solvent substituting unit 4, a dual-cup structure of the fixed cup 43 and the rotating cup 42 was described. However, as with the coating unit 2, a structure with only a fixed cup may be used.

Figure 5:
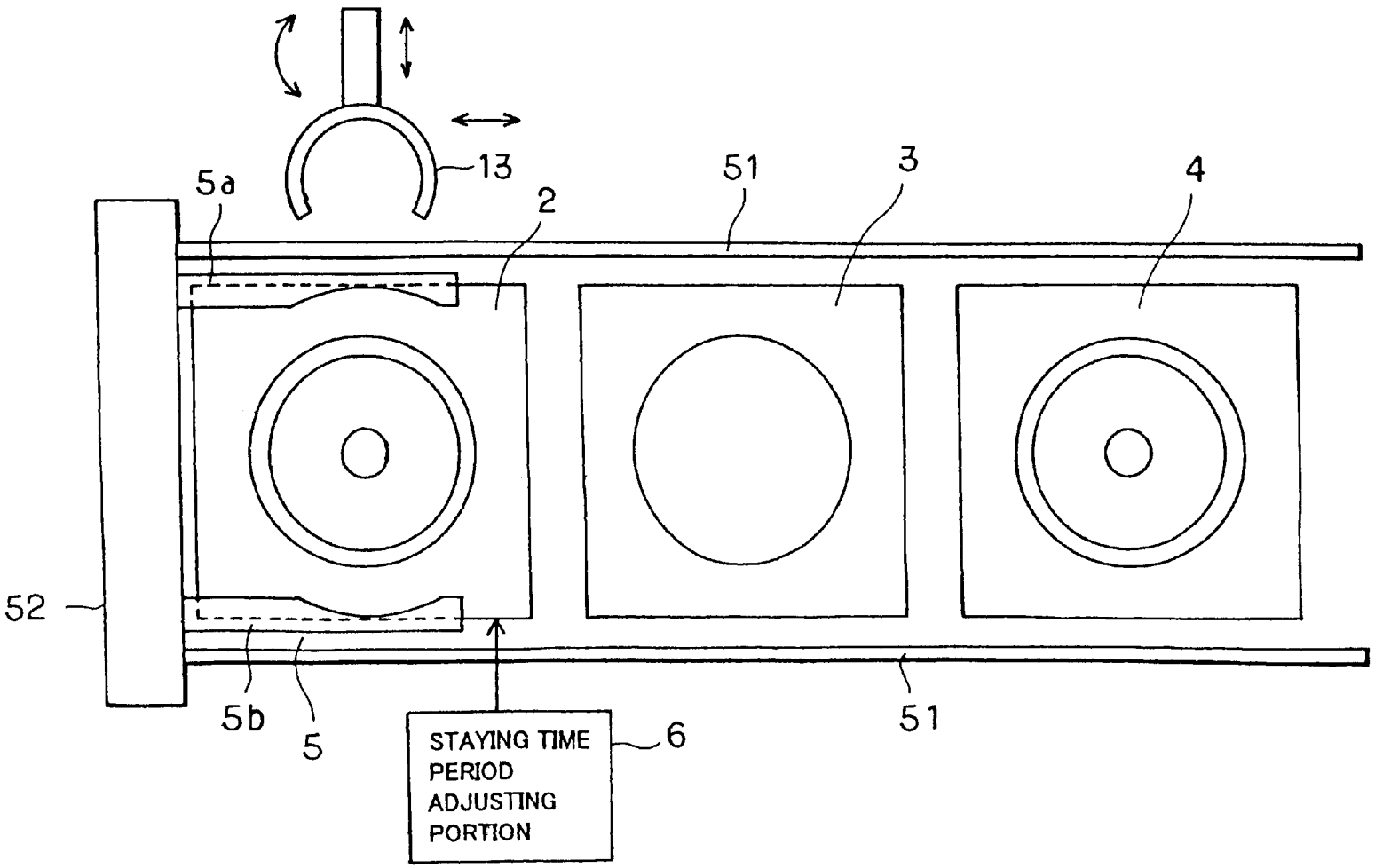
FIG. 5 is a plan view showing principal portions of the embodiment of the present invention.
Figure 6:
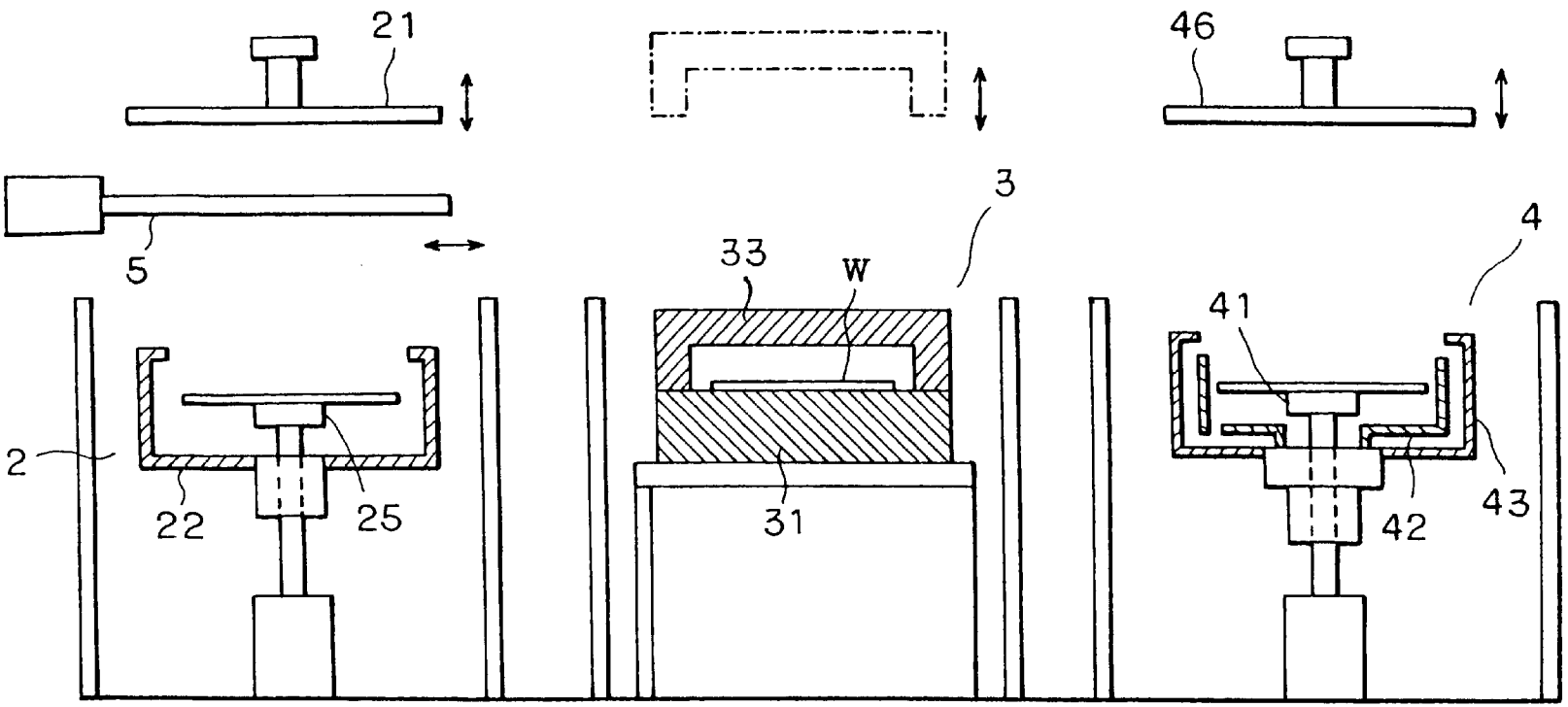
FIG. 6 is a vertical sectional view showing principal portions of the embodiment of the present invention.

In this embodiment, as shown in FIGS. 5 and 6, a sub arm 5 that conveys the wafer W among the coating unit 2, the aging unit 3, and the solvent substituting unit 4 is disposed. The sub arm 5 has a pair of arm members 5*a* and 5*b* that are opened and closed in the horizontal direction by an opening/closing mechanism 52 that is moved along a guide rail 51.

In FIG. 5, reference numeral 6 represents a staying time period adjusting portion that allows the operator to adjust the staying time period of the wafer W in the coating unit (for example, after the wafer W is loaded from the main arm 13 to the chuck 25 until the wafer that has been coated is unloaded from the chuck 25 to the sub arm 5). After the coating solution is supplied from the nozzle 26 to the front surface of the wafer W, the wafer W should be quickly conveyed to the next process so as to prevent the solvent from evaporating. Thus, the staying time period adjusting portion 6 adjusts the waiting time period until for example the coating solution is supplied.

In this embodiment, assuming that the staying time period of the coating unit 2 is denoted by t1, the staying time period of the aging unit 2 is denoted by t2, and the staying time period of the solvent substituting unit 4 is denoted by t3, the relationship that t1>t2 and t1>t3 (whichever longer) should be satisfied. In this example, t2 is two minutes; t3 is one minute; and t1 is three minutes. In the process sequence of the units 2, 3, 4, t1 is a rate determiner.

Figure 7:
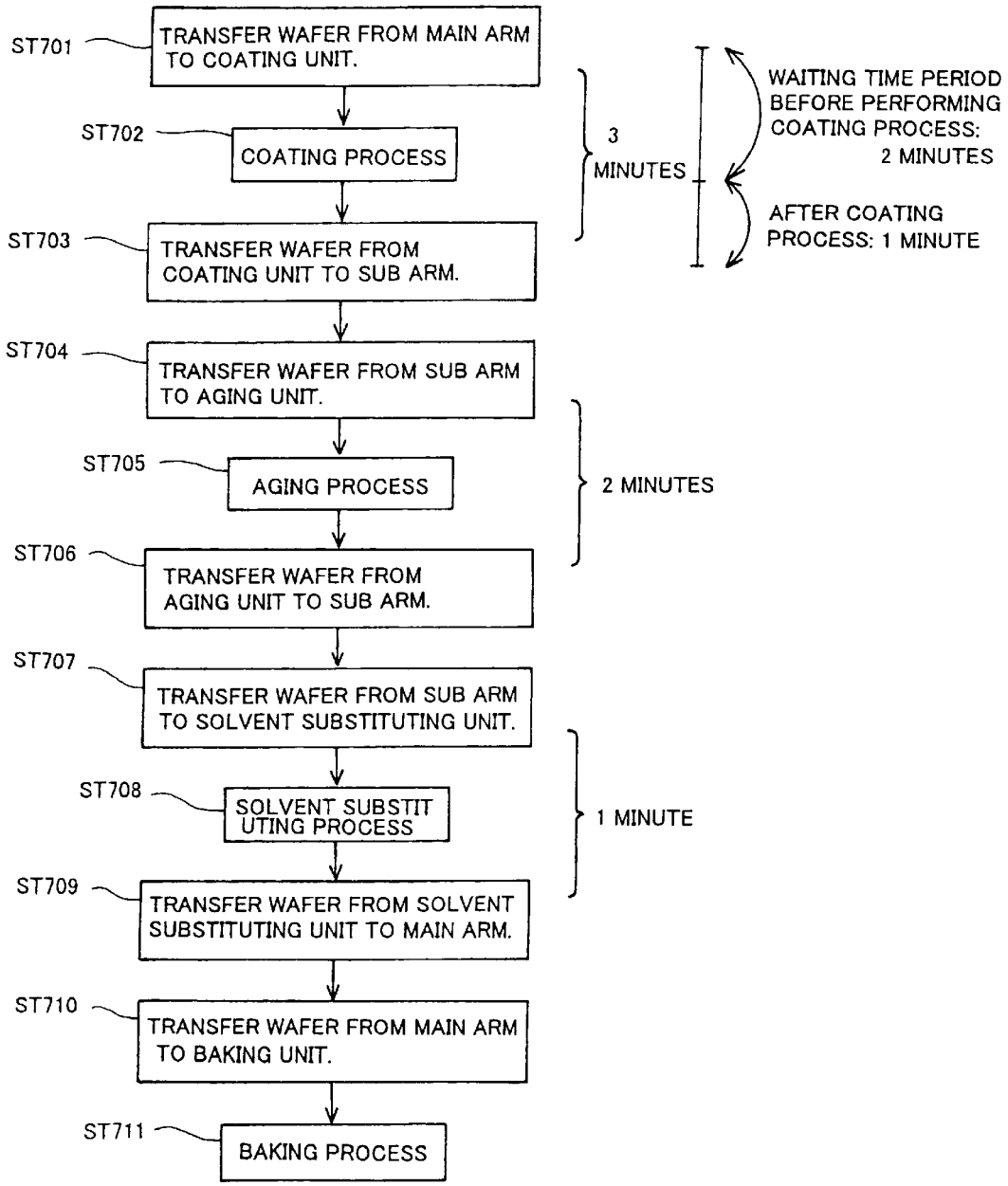
FIG. 7 is a sequence chart showing a process sequence according to the embodiment of the present invention.

Next, the operation of the above-described embodiment will be described. The transferring arm 12 of the input/output port 11 extracts a non-processed wafer W from a cassette C of the cassette stage CS and transfers the wafer W to the main arm 13. FIG. 7 shows a process sequence of the embodiment. In other words, the wafer W is transferred from the main arm 13 to the chuck 25 of the coating unit 2 (at step ST701). As described above, after the coating solution of which sol of TEOS has been dispersed in solvent is coated on the front surface of the wafer W (at step ST702), the wafer W is transferred from the chuck 25 to the sub arm 5 (at step ST703). In this example, from a time when the coating solution is supplied to the front surface of the wafer W in the coating unit 2 and the coating process is completed, to a time when the check 25 is raised to the transferring position of the holding base 5, it takes one minute. However, as described above, the waiting time period before the coating process is performed is adjusted to two minutes so that the staying time period t1 of the coating unit 2 becomes three minutes.

After the coating process is performed, the wafer W is transferred from the sub arm 5 to the rising pins 36 of the aging unit 3 (at step ST704). After the aging process is performed (at step ST705), the wafer W is transferred to the sub arm 5 (at step ST706). Thereafter, the wafer W is transferred from the sub arm 5 to the chuck 41 of the solvent substituting unit (at step ST707). After the solvent substituting process is performed (at step ST708), the wafer W is transferred to the main arm 13 (at step ST709). Thereafter, the wafer W is transferred to the baking unit 4 (at step ST710). The baking unit 4 performs a baking process (for example, for one minute) (at step ST711). Thus, an interlayer insulation film that is a silicon oxide film is formed on the front surface of the wafer W.

According to the above-described embodiment, in the process sequence of the coating process, aging process, and solvent substituting process, the waiting time period is adjusted so that the staying time period of the wafer W in the coating unit 2 is adjusted as a rate determiner. Thus, after a water W that has been coated, it is quickly conveyed to the next process. Consequently, since solvent contained in the coated film is substituted in the state that the solvent is suppressed from evaporating, a designed film thickness can be accomplished. In addition, the time period of which large surface tension of the solvent is applied to the mesh structure of TEOS is short, the structure of the film can be suppressed from breaking.

The present invention can be applied to a structure of which the solvent substituting process is not performed. In this case, the staying time period t1 of the wafer W in the coating unit 2 should be larger than the staying time period t2 of the wafer W in the aging unit 3. The layout of the units 2, 3, and 4 is not limited to the example of the structure shown in FIG. 1. For example, the solvent substituting unit 4 may be disposed at the position of the unit U2 shown in FIG. 1. Alternatively, the units 2, 3, and 4 may be vertically arranged. When the sub arm 5 that conveys the wafer W among the units 2, 3, and 4 is disposed, while the wafer W is being conveyed among the units 2, 3, and 4, another wafer W can be conveyed. However, the present invention can be applied to a structure of which the sub arm 5 is not disposed.

Figure 8:
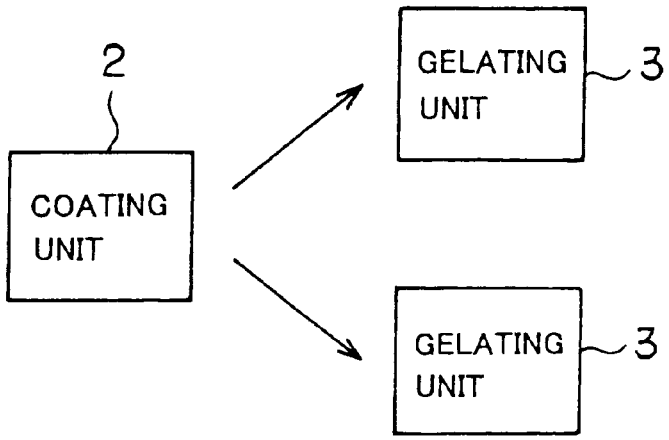
FIG. 8 is a schematic diagram for explaining another embodiment of the present invention.

The present invention can be applied to a structure of which a plurality of gelating units 3 are disposed (in the example shown in FIG. 8, two gelating units 3 are disposed). In this case, the waiting time period of the wafer W in the coating portion 2 is adjusted so that the relationship of $t1>t2/2$ is satisfied. In other words, when n gelating units 3 (where n is an integer that is 1 or more) are disposed, the waiting time period of the coating portion 2 is adjusted so that the relationship of $t1>t2/n$ is satisfied.

Figure 9:
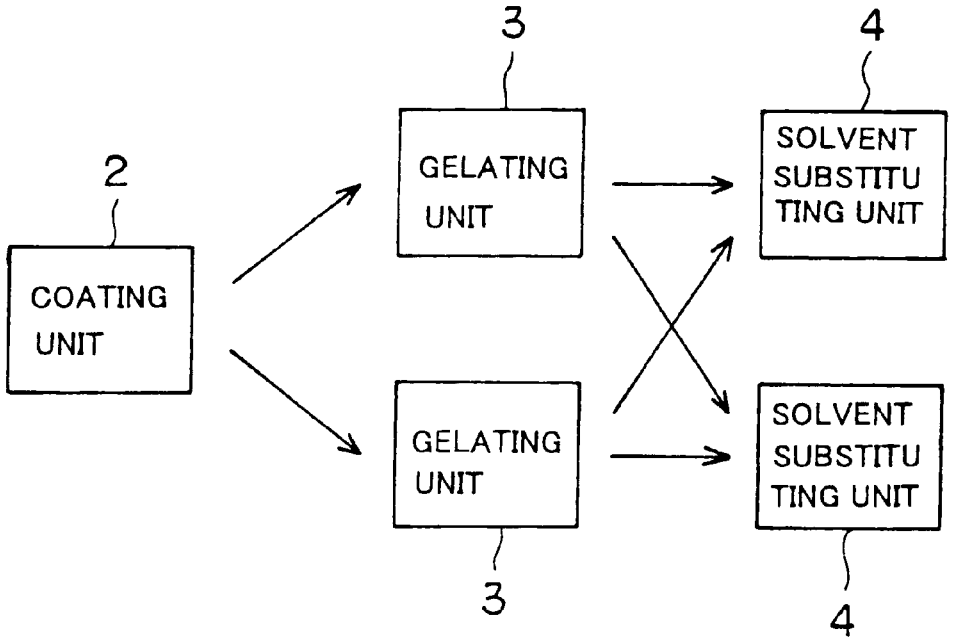
FIG. 9 is a schematic diagram for explaining another embodiment of the present invention.

The present invention can be applied to a structure of which a plurality of solvent substituting units 4 are disposed. When m solvent substituting units 4 (where m is an integer that is 1 or more) are disposed, the waiting time period of the coating portion 2 is adjusted so that the relationships of $t1>t2/n$ and $t1>t3/m$ are satisfied. FIG. 9 shows a structure of which two gelating units 3 and two solvent substituting units 4 are disposed.

Figure 10:
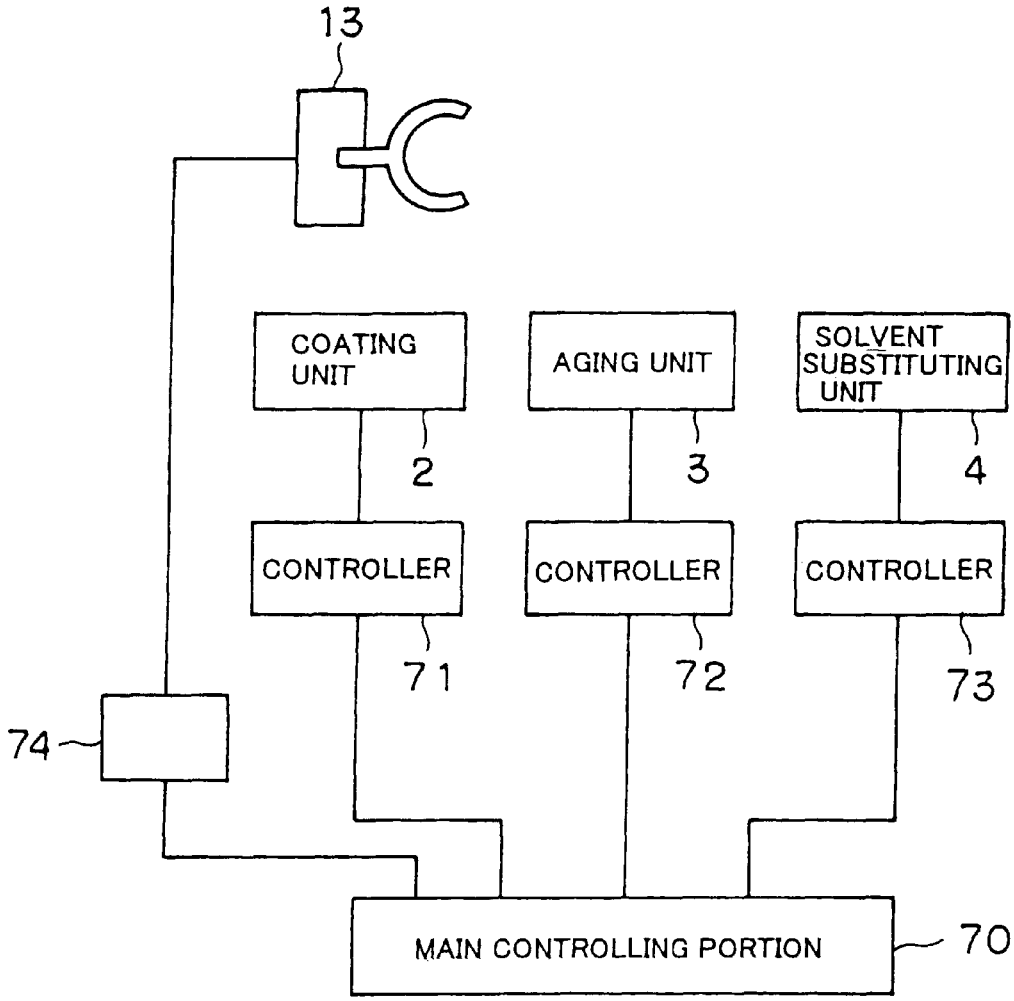
FIG. 10 is a block diagram showing the structure of another embodiment of the present invention.

Next, with reference to FIG. 10, another embodiment of the present invention will be described. In FIG. 10, reference numerals 71 to 73 are controllers that control a coating unit 2, an aging unit 3, and a solvent substituting unit 4, respectively. For example, the controllers 71 to 73 cause a lid 21 (33, 46) to be opened/closed, a chuck 25 (41) or a rising pin 36 to be raised/lowered, a valve of a coating solution (solvent or gas) to be opened/closed, an exhausting valve to be opened/closed, and the chuck 25 (41) to be rotated.

Reference numeral 74 represents a controller that controls a main arm 13. In this example, a sub arm 5 is not disposed. However, when the sub arm 5 is used, a controller that controls the sub arm 5 is disposed. Reference numeral 70 is a main controlling portion that exchanges signals with the controllers 71 to 74. The controller 71 outputs an end signal to the main controlling portion 70 when the coating process of the coating unit 2 is completed (for example, when the rotation of the chuck 25 is stopped or the lid 21 is opened). When the main controlling portion 70 receives the end signal, the main controlling portion 70 outputs a ready command signal to the controller 72. The controller 72 outputs a ready signal to the aging unit 3 so as to cause the aging unit 3 to load the wafer W.

The ready signal causes the lid 33 to be opened or/and the rising pins 36 to be raised to the receiving position of the wafer W. When the controller 71 supplies the end signal to the main controlling portion 70, it outputs a ready command signal to the controller 74. The controller 74 outputs a control signal to the main arm 74 (or the sub arm 5) so that the main arm 13 stops in front of the coating unit 2.

After the gelating process of the gelating process unit 3 is completed (for example, the lid 33 is separated from the gelating process unit 3 or after the wafer W is loaded and the gelating process unit 33 is closed with the lid 33, the timer times up), the controller 72 outputs an end signal to the main controlling portion 70. Likewise, the controller 73 outputs a ready signal to the solvent substituting unit 4. In addition, the main controlling portion 70 outputs a control signal to the main arm 13 (or the sub arm 5) so that the main arm 13 stops.

According to the embodiment, after the coating solution is applied on the front surface of the wafer W, the aging process and the solvent substituting process are quickly performed. Thus, the solvent can be suppressed from evaporating. Consequently, the same effect as the above-described embodiment can be obtained. In this embodiment, the present invention can be applied to a structure of which the solvent substituting unit 4 is not used. When this embodiment and the above-described embodiment are combined, the process sequence can be more quickly performed.

Next, another embodiment of the present invention will be described.

Figure 11:
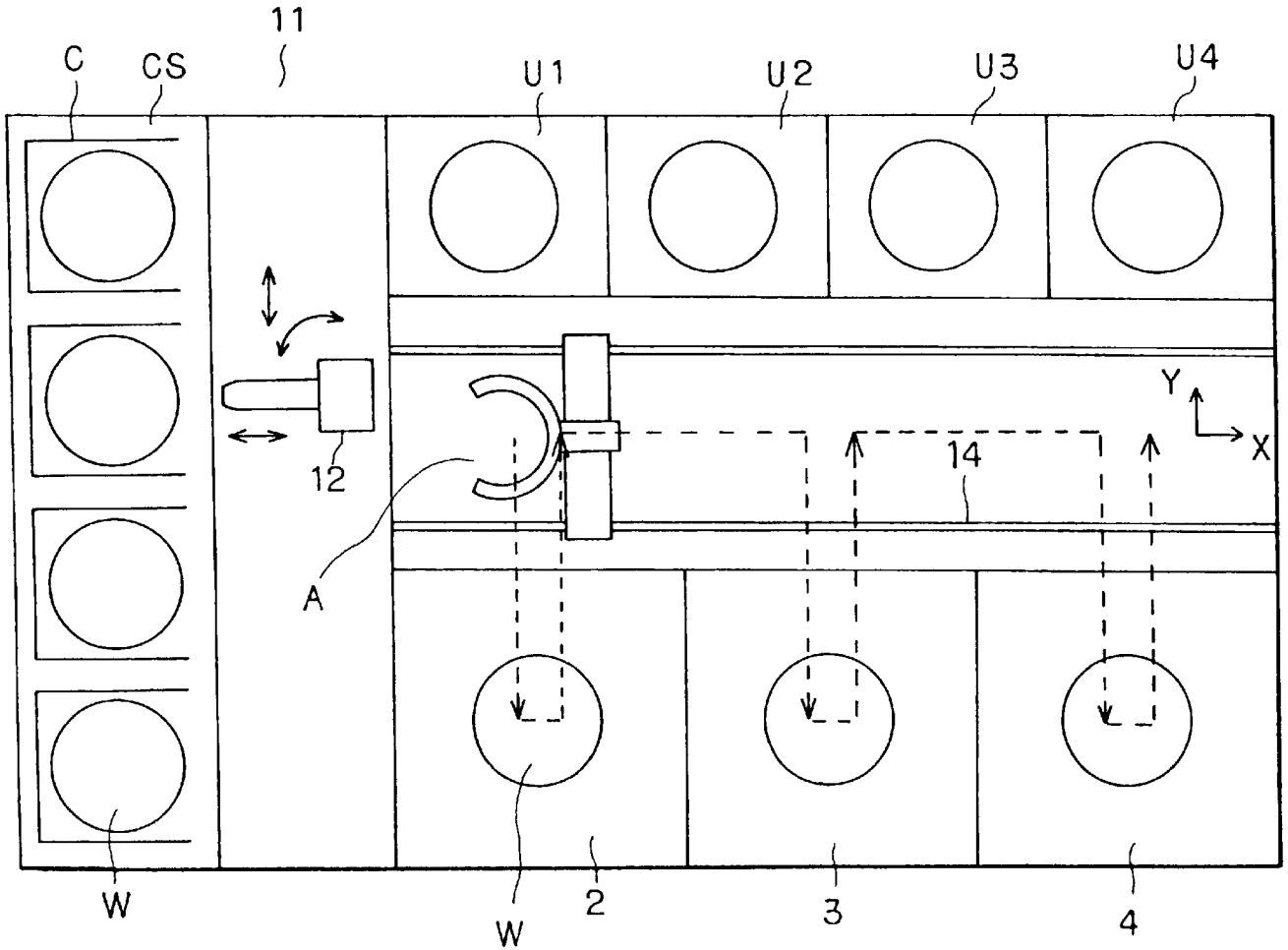
FIG. 11 is a schematic diagram showing a flow of a wafer of a coated film forming apparatus according to another embodiment of the present invention.

In the above-described embodiment, the wafer W is conveyed among the coating unit 2, the aging unit 3, and the solvent substituting unit 4 by the dedicated sub arm 5. In this embodiment, however, the present invention is applied to a coated film forming apparatus of which a wafer W is conveyed among a coating unit 2, an aging unit 3, and a solvent substituting unit 4 by a main arm A as denoted by dotted lines shown in FIG. 11.

In the coating unit 2, the main arm A transfers a wafer W to a chuck 25 shown in FIG. 2. Thereafter, a cup 22 is securely closed with a lid 21. While the cup 22 is being exhausted, steam of ethylene glycol is supplied to the cup 22. In the cup 22 that is filled with a steam of ethylene glycol, a coating solution T is supplied to a rotating center portion of the front surface of the wafer W from a coating solution nozzle 26 (at step ST1201 shown in FIG. 12). Thereafter, the wafer W is rotated. Thus, the coating solution T spreads out on the entire front surface of the wafer W due to centrifugal force. Consequently, a coated film F is formed (at step ST1202 shown in FIG. 12). Since the cup 22 is filled with a steam of ethylene glycol, the solvent contained in the coating solution T is suppressed from evaporating.

The coating solution T is solution of which colloid or particles of TEOS that is metal alkoxide has been dispersed in a solvent that contains ethylene glycol, ethyl alcohol, a water, and a small amount of hydrochloric acid. Ethylene glycol allows the viscosity of the coating solution to be properly adjusted when the coating solution is coated. In addition, ethylene glycol remains as a solvent after ethyl alcohol whose vapor pressure is low evaporates so as to suppress the film thickness from decreasing.

After the coating process is completed, the resultant wafer W is conveyed from the coating unit 2 to the aging unit 3 by the main arm 13.

The aging unit 3 gelates colloid of TEOS contained in the coated film of the wafer W so as to link the colloid in mesh shape. Thus, the lid 33 of the aging unit 3 as shown in FIG. 3 is separated from the aging unit 3. The wafer W is transferred from the main arm A to the heating plate 31. Thereafter, the process chamber S is securely closed with the lid 32. While the process chamber S is being exhausted, the steam of ethylene glycol is supplied to the process chamber S. In the process chamber S that is filled with steam of ethylene glycol is heated to around 100° C. by the heating plate 31 (at step S1203 shown in FIG. 12).

In the heating process, colloid of TEOS is acceleratingly gelated. Alternatively, with an ammonium gas as alkali catalyst, colloid of TEOS can be acceleratingly gelated. In addition, the steam of ethylene glycol is supplied to the process chamber S so as to suppress the solvent contained in the coated film from evaporating. Thus, the temperatures of the pipes and the steam source are adjusted so that steam of 100 RH % is obtained at the temperature in the process chamber S.

After the heating process is performed, the resultant wafer W is conveyed from the aging unit 3 to the solvent substituting unit 4 by the main arm 13.

Figure 12:
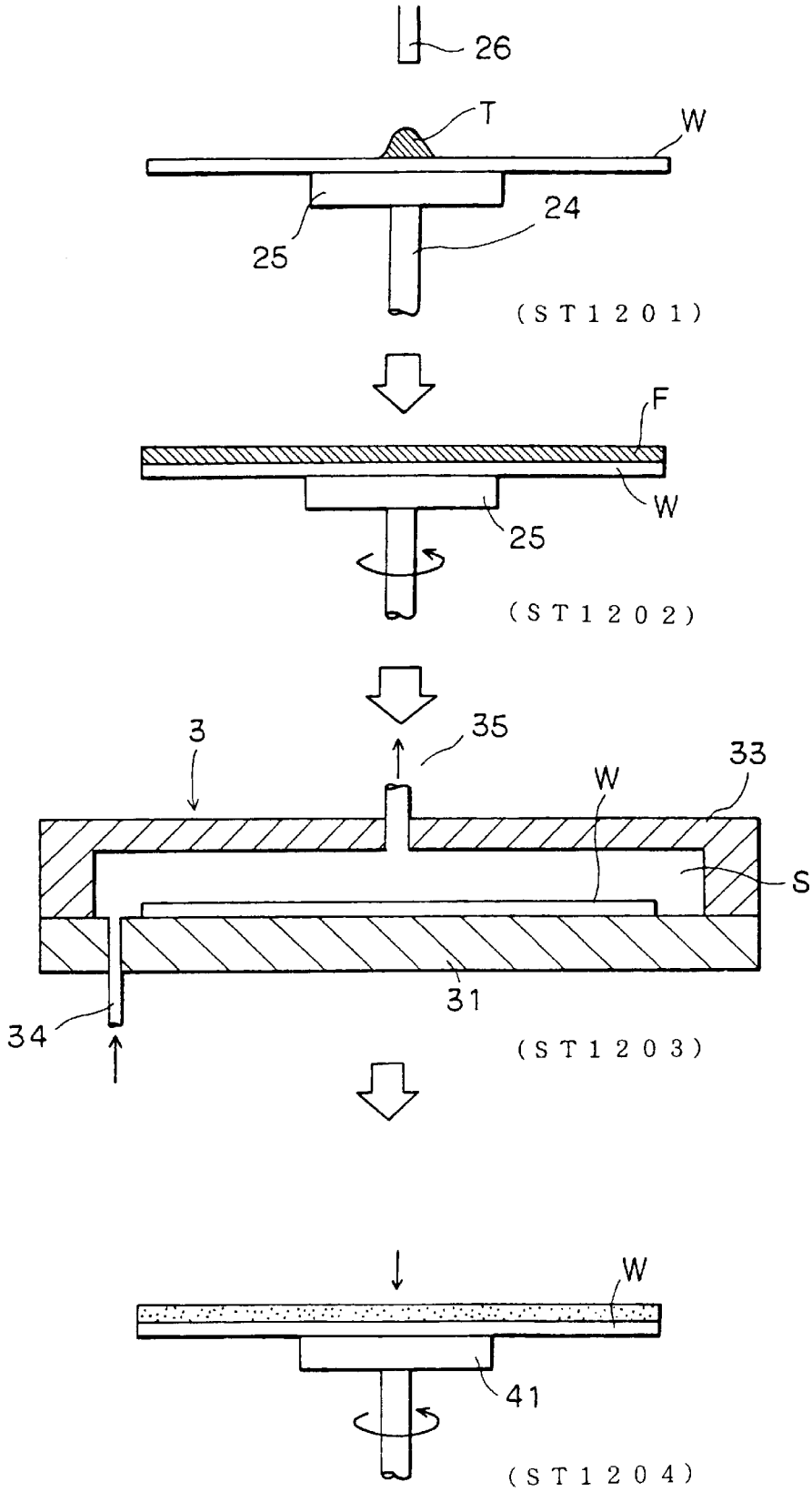
FIG. 12 is a sequence chart for explaining the operation of the coated film forming apparatus shown in FIG. 11.

In the solvent substituting unit 4, ethanol, HMDS (hexamethyldiamine), and heptane are successively supplied to the rotating center portion of the front surface of the wafer W so as to substitute the solvent contained in the coated film with another solvent (at step ST1204 shown in FIG. 12). Thus, in the solvent substituting unit 4, as shown in FIG. 4, ethanol, HMDS, and heptane are successively supplied to the rotating center portion of the front surface of the wafer W held by a spin chuck 41 that is horizontally rotated.

After the solvent substituting process is performed, the resultant wafer W is conveyed to the baking unit by the main arm A. In the baking unit, a baking process is performed. Thus, an interlayer insulation film that is a silicon oxide film is formed on the front surface of the wafer W.

Figure 13:
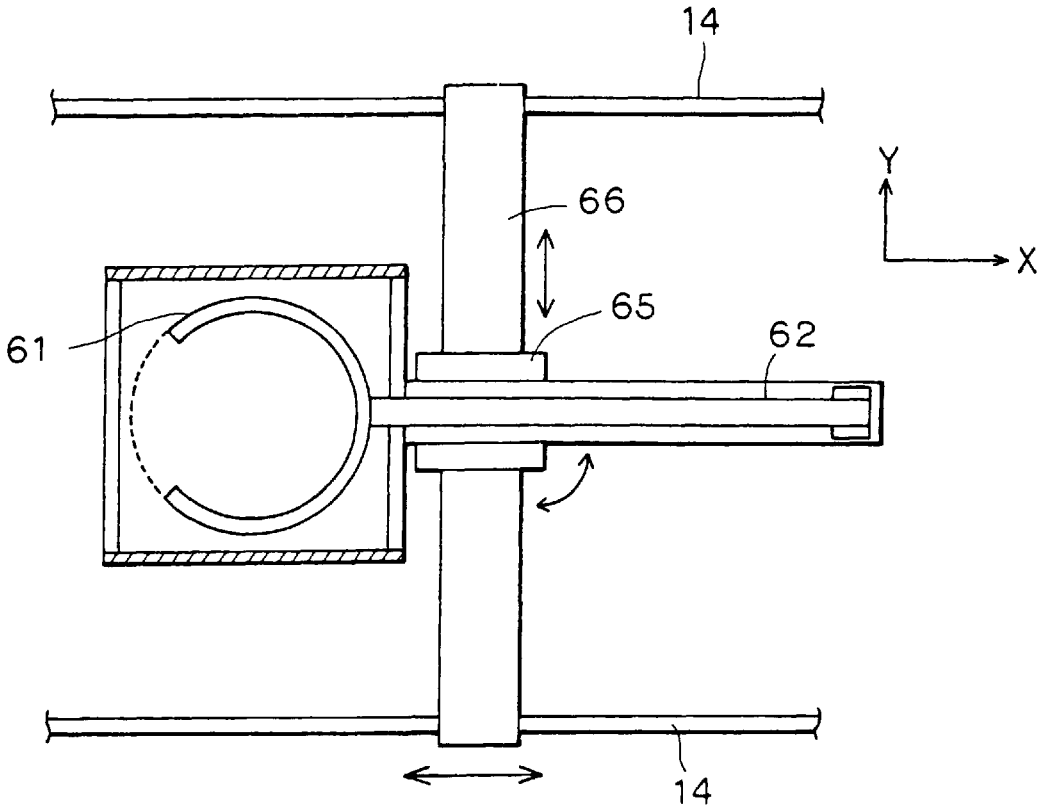
FIG. 13 is a plan view showing the structure of a main arm of the coated film forming apparatus shown in FIG. 11.
Figure 14:
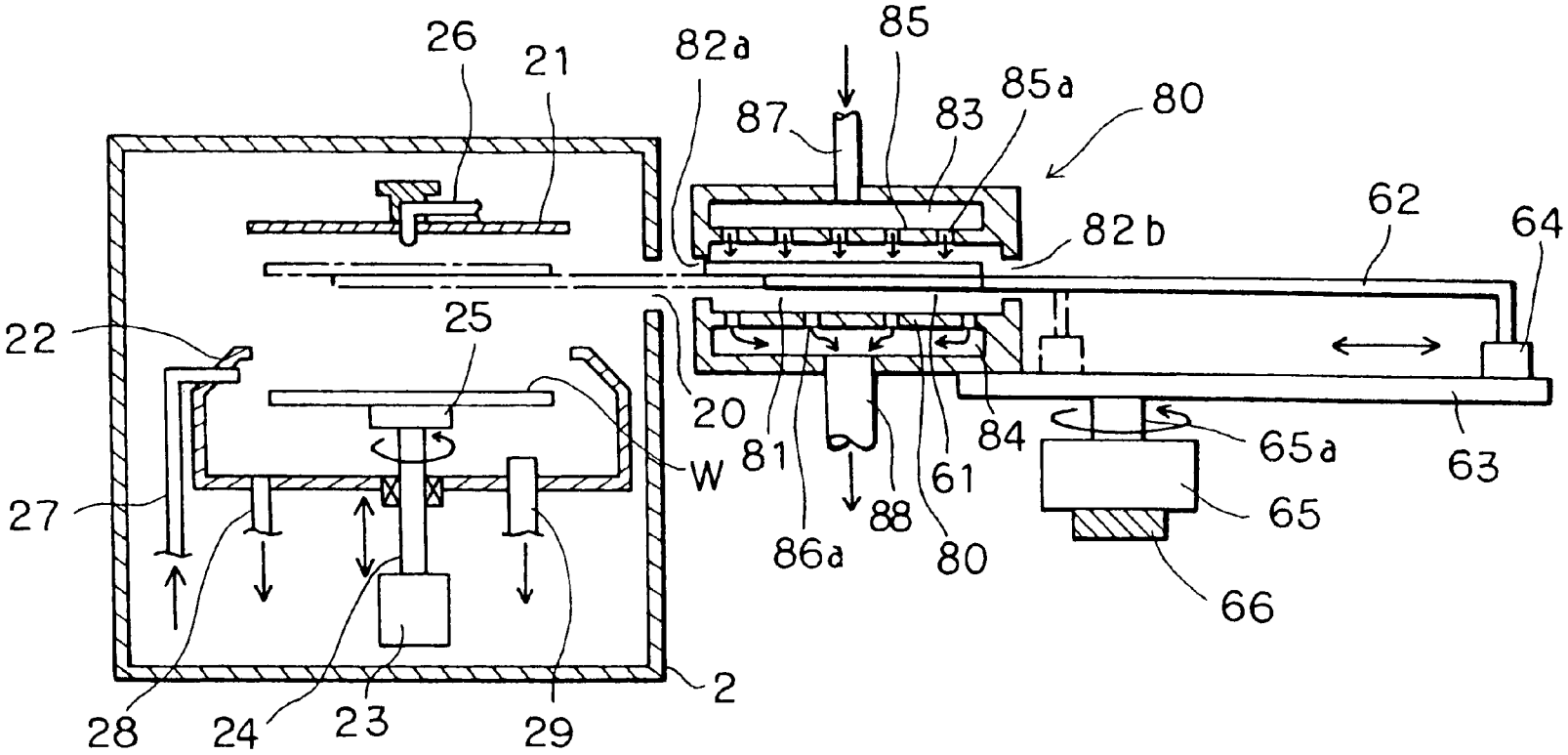
FIG. 14 is a vertical sectional view showing the main arm shown in FIG. 13.
Figure 15:
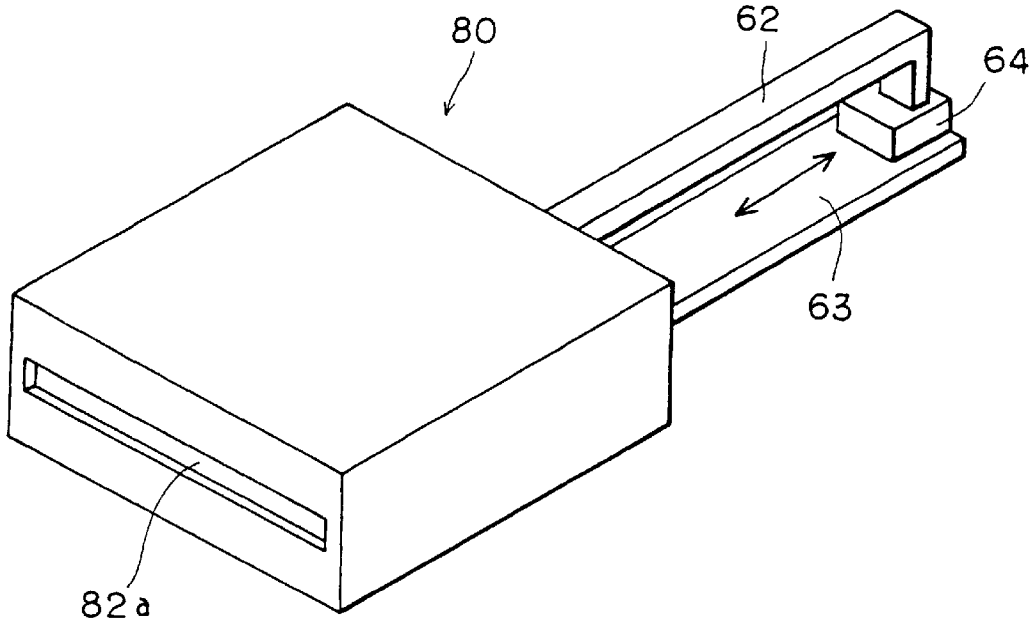
FIG. 15 is a perspective view showing the structure of the main arm shown in FIG. 14.

Next, with reference to FIGS. 13 to 15, the structure of the main arm A will be described. FIG. 13 is a plan view showing an example of the structure of the main arm A according to an embodiment of the present invention. FIG. 14 is a side view of the main arm A. FIG. 15 is a perspective view of the main arm A. In FIG. 13, reference numeral 61 is a horseshoe shaped arm member as a substrate conveying member that holds a part of the periphery of the lower surface of the wafer W. The arm member 61 is disposed at an edge of a sliding member 62. The sliding member 62 is moved along the upper surface of a horizontal moving base 63 by a guiding member 64.

The moving base 63 is rotated in the horizontal direction by a rotating mechanism 65 connected through a vertical rotating shaft 65*a*. The rotating mechanism 65 is moved along the upper surface of a guide base 66 extending in the y axis between two guide rails 14 and 15. The guide base 66 is moved along the guide rails 14 and 15.

When the arm member 61 is retreated in a conveying position (denoted by a solid line in FIG. 14), a vessel 80 is disposed around the arm member 61 in such a manner that the vessel 80 surrounds the arm member 61. The lower surface of the rear edge of the vessel 80 is disposed on the upper surface of the front edge of the moving base 63 (in FIG. 14, the left side represents the front edge side, whereas the right side represents the rear edge side). Thus, when the arm member 61 is placed in the conveying position, the arm member 61 is rotated around the vertical axis and moved in the x and y directions in such a manner that the arm member 61 is surrounded by the vessel 80.

A passage 81 is formed in the vessel 80 in such a manner that the passage 81 allows the arm member 61 with the wafer W to pass through the moving base 63. In addition, opening portions 82*a* and 82*b* are formed on a front edge surface and a rear edge surface of the vessel 80 in such a manner that the opening portions 82*a* and 82*b* allow the arm member 61 with the wafer W to pass. The height and position of a loading/unloading opening 20 for the wafer W of each unit (for example, the coating unit 2 in FIG. 14) accord with those of the opening portions 82*a* and 82*b*. Alternatively, the arm member 61 may be vertically moved. In this case, the height of each of the opening portions 82*a* and 82*b* may not accord with the height of the loading/unloading opening 20.

An upper gas chamber 83 and a lower gas chamber 84 are formed on the upper side and the lower side of the passage of the arm member 61, respectively. The lower surface of the upper gas chamber 83 and the upper surface of the lower gas chamber 84 are formed as gas dispersing plates 85 and 86, respectively. Many gas holes 85*a* and 86 are formed in the gas dispersing plates 85 and 86, respectively.

A steam supplying pipe (vapor supplying pipe) 87 that supplies steam (vapor) of a component (for example, ethylene glycol) of the solvent contained in the coating solution T is connected to the upper gas chamber 83. In addition, an exhausting pipe 88 is connected to the lower gas chamber 84. Thus, when steam of ethylene glycol is supplied to the vessel 80, ethylene glycol is dispersed in the vessel 80. Thus, the vessel 80 is filled with steam of ethylene glycol as atmospheric gas.

The main arm A conveys the waver W among each unit. Next, the operation of the main arm A will be described in the case that the main arm A conveys the wafer W from the coating unit 2 to the aging unit 3.

In the coating unit 2, after the predetermined process is performed, the lid 21 is opened and then the chuck 25 is raised. On the other hand, in the main arm A, the moving base 63 is moved to the unloading position of which the wafer W is unloaded from the coating unit 2 so that the front opening portion 82*a* on the front side of the vessel 80 faces the loading/unloading opening 20 of the coating unit 2. Thereafter, the arm member 61 is advanced so that the arm member 61 enters the coating unit 2 through the front opening portion 82*a* and the loading/unloading opening 20 as shown in FIG. 14. At a position denoted by a dashed line shown in FIG. 14, the wafer W is transferred from the chuck 25 to the arm member 61. Thereafter, the arm member 61 is retreated to the conveying position.

While the vessel 80 is being exhausted through the exhausting pipe 88, the steam of ethylene glycol is supplied from the steam supplying pipe 87 to the upper gas chamber 83. Thus, the steam of ethylene glycol is supplied to the passage 81 of the vessel 80 in such a manner that ethylene glycol is dispersed by the gas dispersing plate 85.

In the state that the arm member 61 is placed in the conveying position (namely, the arm member 61 with the wafer W is surrounded by the vessel 80), the main arm A is moved to the aging unit 3 so that the front opening portion 82*a* of the vessel 80 faces a loading/unloading opening (not shown) of the aging unit 3. As shown in FIG. 3, likewise, the arm member 61 is advanced so that it enters the aging unit 3. In the process chamber S of which the lid 33 has been opened, the wafer W is transferred to the heating plate 31 in association with the rising pins 36. Thereafter, the aim member 61 is retreated to the conveying position (namely, the inside of the vessel 80). The arm member 61 is kept in this position.

In this embodiment, since the wafer W is conveyed in the atmosphere of the steam of ethylene glycol that is a component of the solvent of the coating solution, the solvent contained in the coated film on the front surface of the wafer W is suppressed from evaporating. Thus, in the state that the solvent of the coated film is suppressed from evaporating, the wafer W can be conveyed from the coating unit 2 to the aging unit 3. Consequently, in the state that the solvent is suppressed from evaporating, a colloid or particles of TEOS can be gelated. Thus, since the gelating process is properly performed, a designed film thickness can be accomplished.

In addition, when the wafer W is conveyed from the aging unit 3 to the solvent substituting unit 4, the solvent contained in the coated film can be suppressed from evaporating. Thus, since the time period of which large surface tension of the solvent is applied to the mesh structure of TEOS becomes short, the film structure can be prevented from breaking. Consequently, a more excellent thin film can be formed.

Figure 16:
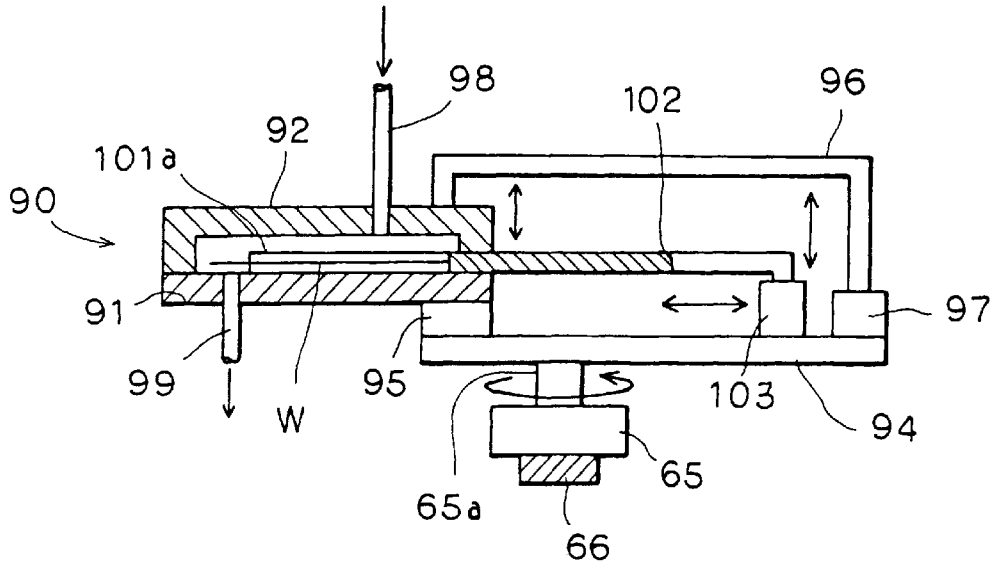
FIG. 16 is a vertical sectional view showing the structure of a main arm according to another embodiment of the present invention.
Figure 17:
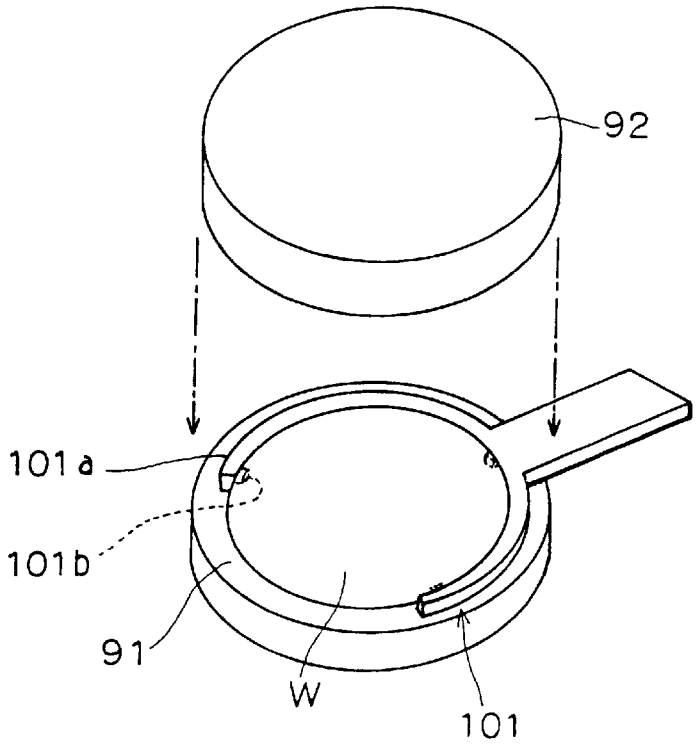
FIG. 17 is a perspective view showing the structure of the main arm shown in FIG. 16.

Next, with reference to FIGS. 16 and 17, a main arm A according to another embodiment will be described. The difference between this embodiment and the above-described embodiment is in that an air-tight vessel that can be separated into an upper portion and a lower portion is used. In FIG. 16, reference numeral 90 is a vessel that has a space for an arm member 101 that is a substrate conveying member that holds a wafer W. The vessel 90 is composed of a plate 91 and a lid portion 92 that contacts the periphery of the plate 91.

The lower surface on the rear edge side of the plate 91 is secured to the upper surface on the front edge side of a horizontal moving base 94 through a mounting member 95. On the other hand, the lid portion 92 is held by a supporting lever 96 in such a manner that the lid portion 92 is hung by the supporting lever 96. The lid portion 92 is raised/lowered by a raising/lowering mechanism 97 disposed on the rear edge side of the moving base 94 through the supporting lever 96. A steam supplying pipe (vapor supplying pipe) 98 is connected to the upper surface of the lid portion 92. The steam supplying portion 98 supplies stream (vapor) of ethylene glycol that is a component of the solvent of the coating solution T. In addition, an exhausting pipe 99 is connected to the plate 91.

On the other hand, protrusions 101*b* are formed at for example, three positions on the inner surface of a horseshoe shaped frame 101*a* that surrounds a part of the periphery of the wafer W. The arm member 101 is disposed at the front edge of a sliding member 102 that is moved and raised/lowered along the moving base 94 by a driving mechanism 103. As with the moving base 63 shown in FIGS. 14 and 15, the moving base 94 is rotated by a rotating mechanism 65 through a rotating shaft 65*a*. The rotating mechanism 65 is moved along the upper surface of the guide base 66.

When the arm member 101 is placed in the conveying position (denoted by a solid line shown in FIG. 16), the arm member 101 is housed in the vessel 90. In other words, the lid portion 92 has a cut-out portion corresponding to the sliding member 102. When the arm member 101 is placed in the conveying position, the sliding member 102 contacts the plate 91. Thus, the lid portion 92 contacts the plate 91 through the sliding member 102. Consequently, in this embodiment, when the arm member 101 is placed in the conveying position, the arm member 101 is rotated around the vertical axis and moved in the x and y directions in the state that the arm member 101 is surrounded by the vessel 90.

When the wafer W is conveyed from the coating unit 2 to the aging unit 3 by the main arm A, the moving base 94 is moved to the unloading position at which the wafer W is unloaded from the coating unit 2 so that the front surface of the vessel 90 faces the loading/unloading opening 20 of the coating unit 2. Thereafter, the lid portion 92 is raised. In addition, the sliding member 102 is slightly raised. Thereafter, the arm member 101 comes into the coating unit 2. After the wafer W is transferred from the chuck 25 to the arm member 101, the arm member 101 is retreated to the conveying position. The sliding member 102 and the lid portion 92 are lowered so as to securely close the vessel 90.

The vessel 90 is exhausted through the exhausting pipe 99. In addition, the steam of ethylene glycol is supplied from the stream supplying pipe 98 to the vessel 90. At this point, the main arm A is moved to the aging unit 3 in the state that the arm member 101 with the wafer W is surrounded by the vessel 90 in such a manner that the front surface of the vessel 90 faces a loading/unloading opening (not shown) of the aging unit 3. At this point, the vessel 90 is filled with the steam of ethylene glycol as atmospheric gas.

Likewise, after the lid portion 92 and the sliding member 102 are raised, the arm member 101 comes into the aging unit 3. The wafer W is transferred to the heating plate 31 in association with the rising pins 36 shown in FIG. 3. Thereafter, the arm member 101 is retreated to the conveying position. The lid portion 92 and the sliding member 102 are lowered. The arm member 101 is kept in the position in the state that the vessel 90 is securely closed with the lid portion 92.

In this embodiment, since the wafer W is conveyed in the state that it is securely housed in the vessel 90, while the wafer W is being conveyed among each unit, the front surface of the wafer W is hardly exposed to the air. Thus, the wafer W is prevented from adhering to particles. In addition, unnecessary reactions of the coated film on the front surface of the wafer W to air are suppressed. Moreover, when the wafer W is conveyed from the coating unit 2 to the aging unit 3 or from the aging unit 3 to the solvent substituting unit 4, the solvent of the coated film formed on the front surface of the wafer W can be suppressed from evaporating. Thus, the gelating process is properly performed and the film structure is suppressed from breaking. Consequently, a more excellent thin film can be formed. When steam of ethylene glycol is supplied to the vessel 90, the solvent can be more suppressed from evaporating in the vessel 90. Thus, a more excellent thin film can be formed.

Figure 18:
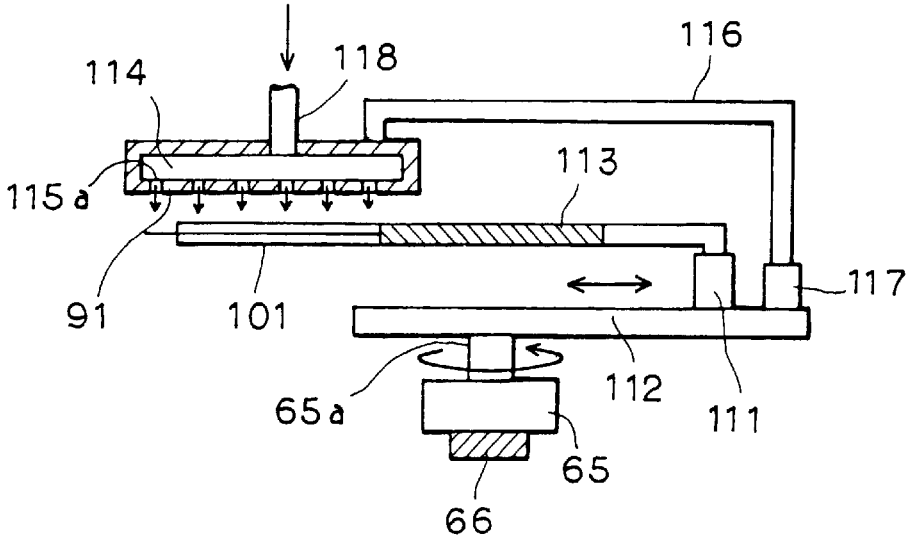
FIG. 18 is a vertical sectional view showing the main arm according to another embodiment of the present invention.
Figure 19A:
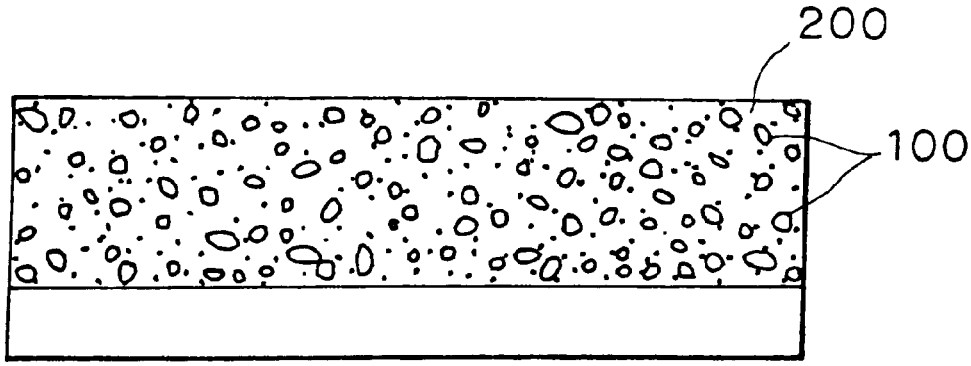
FIGS. 19A to 19C are sectional views for explaining states of denaturation of a coated film in sol-gel method.
Figure 19B:
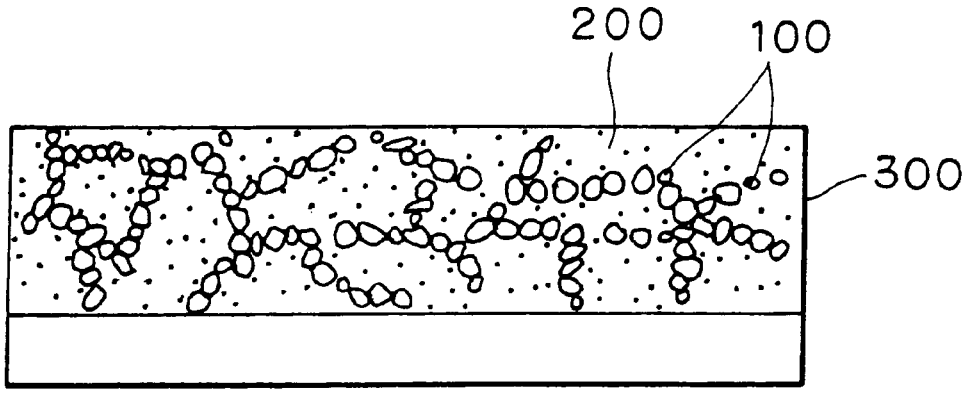
Figure 19C:
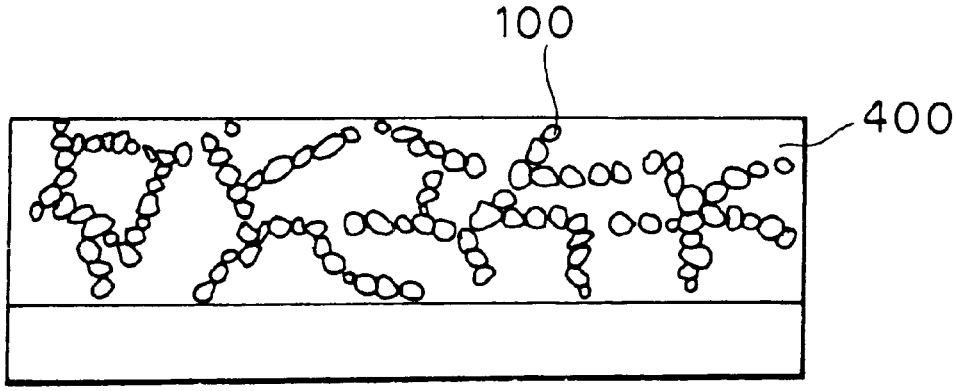

According to the present invention, the main arm A may be structured as shown in FIG. 18. In this example, when the main arm A holds and conveys the wafer W, a steam of the component of the solvent of the coating solution T is supplied to the front surface of the wafer W so as to prevent the front surface of the wafer W from contacting air.

In FIG. 18, reference numeral 101 represents an arm member that holds the wafer W. As with the arm member shown in FIGS. 16 and 17, the arm member 101 is disposed at an edge of a sliding member 113 that is moved along a moving base 112 by a driving mechanism 111. As with the moving base 63 shown in FIGS. 14 and 15, the moving base 112 is rotated by a rotating mechanism 65 through a rotating shaft 65*a*. The rotating mechanism 65 is moved along the upper surface of a guide base 66.

A gas chamber 114 is formed above the arm member 101 in a conveying position (denoted by a solid line in FIG. 18) in such a manner that the gas chamber 114 faces the wafer W. The lower surface of the gas chamber 114 is formed as a gas dispersing plate 115 having many gas holes 115*a*. The gas chamber 114 is held by a holding lever 116 in such a manner that the gas chamber 114 is hung by the holding lever 116. The gas chamber 114 is secured on for example the rear edge side of a moving base 112 through the holding lever 116. A steam supplying pipe 118 is connected to the upper surface of the gas chamber 114. The steam supplying pipe 118 supplies a steam of a component of the solvent (for example, ethylene glycol). Thus, the steam of ethylene glycol is supplied to the entire arm member 101 at the conveying position through the gas chamber 114.

When the wafer W is conveyed from the coating unit 2 to the aging unit 3, in the main arm A, the moving base 112 is moved to the unloading position of which the wafer W is unloaded from the coating unit 2 so that the front surface of the arm member 101 faces a loading/unloading opening 20 of the coating unit 2. Thereafter, the sliding member 113 comes into the coating unit 2. The wafer W is obtained from the chuck 25. Thereafter, the arm member 101 is retreated to the conveying position. While steam of ethylene glycol is being supplied to the front surface of the wafer W through the gas chamber 114, the main arm A is conveyed to the aging unit 3.

In the main arm A, since the wafer W is conveyed in the state that the stream of ethylene glycol is supplied to the front surface of the wafer W, the solvent of the coated film formed on the front surface of the wafer W can be suppressed from evaporating. Thus, since the gelating process is properly performed, the film structure can be suppressed from breaking. Consequently, an excellent thin film can be formed.

The present invention can be applied to a structure of which the solvent substituting process is not performed.

Alternatively, the substrate may be a glass substrate for a liquid crystal display rather than a wafer.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. An apparatus for forming a film on the front surface of a substrate, comprising:

a coating portion configured to coat a coating solution of which particles of a starting substance of a film forming component has been dispersed in a first solvent on the front surface of the substrate so as to form a coated film;

at least one gelating process portion configured to gelate particles of the coated film; and means for loading the substrate to said coating portion, conveying the substrate to said gelating process portion, and unloading the substrate from said gelating process portion, wherein said coating portion comprises a staying time period adjusting portion that adjusts a waiting time period in accordance with a time period after the substrate is loaded to said gelating process portion until the substrate is unloaded from said gelating process portion, so that said coating portion starts to coat the coating solution to the front surface of the substrate after causing the substrate to be stayed for said waiting time period.

2. The apparatus as set forth in claim 1, wherein the number of said gelating process portions is n, and wherein the waiting time period for the substrate stayed in said coating portion is adjusted so that t1 is more than t2/n, where t1 is a time period after the substrate is loaded from said conveying means to said coating portion until the substrate is unloaded from said coating portion to said conveying portion; t2 is a time period after the substrate is loaded from said conveying mans to said gelating process portion until the substrate is unloaded from said gelating process portion to said conveying means.

3. The apparatus as set forth in claim 1, wherein said means for loading, conveying, and unloading includes:

a dedicated conveying portion configured to convey the substrate from said coating portion to said gelating process portion.

4. The apparatus as set forth in claim 1, wherein the first solvent is an organic solvent.

5. The apparatus as set forth in claim 1, wherein the starting substance of the film forming component is metal alkoxide.

6. The apparatus as set forth in claim 1, further comprising:

at least one solvent substituting process portion for supplying a second solvent to the substrate that has been processed in said gelating process portion, and substituting the first solvent contained in the coated film with the second solvent.

7. The apparatus as set forth in claim 6, wherein said means for loading, conveying, and unloading is configured to load the substrate to said coating portion, convey the substrate from said coating portion to said gelating process portion and said solvent substituting process portion, and to unload the substrate from said solvent substituting process portion, and wherein the waiting time period for the substrate stayed in said coating portion is adjusted so that t1 is more than t2/n or t3/m, whichever is longer, where t1 is a time period after the substrate is loaded to said coating portion until the substrate is unloaded from said coating portion; t2 is a time period after the substrate is loaded to said gelating process portion until the wafer is unloaded from said gelating process portion; and t3 is a time period after the wafer is loaded to said solvent substituting process portion until the wafer is unloaded from the solvent substituting process portion.

8. The apparatus as set forth in claim 1, further comprising:

means for supplying a vapor of a component of the first solvent to the front surface of the coated film so as to suppress the first solvent from evaporating from the coated film.

9. An apparatus for forming a film on the front surface of a substrate, comprising:

a coating portion configured to coat a solution of which particles of a starting substance of a film forming component have been dispersed in a first solvent on the front surface of the substrate so as to form a coated film;

a gelating process portion configured to gelate particles contained in the coated film;

means for loading the substrate to said coating portion, conveying the substrate to said gelating process portion, and unloading the substrate from said gelating process portion; and means for outputting a first ready signal to said gelating process portion when the coating process of said coating portion is completed, wherein said first ready signal causes said gelating process portion to prepare to receive and process said substrate immediately after said coating process is complete, thereby suppressing evaporation of said coating solution.

10. The apparatus as set forth in claim 9, further comprising:

means for supplying a second solvent to the substrate that has been processed in said gelating process portion and substituting the first solvent contained in the coated film with the second solvent; and means for outputting a second ready signal to said solvent substituting process portion when the gelating process of said gelating process portion is completed, wherein said means for loading, conveying, and unloading loads the substrate to said coating portion, conveys the substrate to said coating portion, said gelating process portion, and said solvent substituting portion, and unloads the substrate from said solvent substituting process portion.

11. An apparatus for conveying a substrate having a coated film which contains a starting substance of a film component and a solvent, comprising:

a substrate conveying member configured to hold and convey the substrate;

means for supplying a vapor of a component of the solvent to the front surface of the coated film so as to suppress the solvent contained in the coated film from evaporating, a moving base, said substrate conveying member having an arm member advanced and retreated to said moving base, and said means for supplying a vapor being disposed on said moving base in such a manner that said vapor of the solvent is supplied to the substrate that is held by the arm member when the arm member is retreated, a vessel, disposed on said moving base, and configured to house the arm member and the substrate when the arm member is retreated, said means for supplying a vapor being disposed in said vessel, and means provided on the vessel, for exhausting said vapor supplied from said vapor supplying means.

12. A method for forming a film on the front surface of a substrate, comprising the steps of:

(a) causing the substrate to be stayed at a coating position for a predetermined time period;

(b) at the coating position, coating a coating solution including particles of a starting substance of a film forming component dispersed in a solvent on the front surface of the substrate so as to form a coated film after said time period;

(c) conveying the substrate on which the coated film has been formed from the coating position to a gelating process position; and (d) gelating particles contained in the coated film at the gelating process position, wherein said predetermined time period is set such that said substrate is conveyed from the coating position to the gelating position and subjected to the gelating process immediately after said coating step, thereby suppressing evaporation of the coating solution.

13. The method as set forth in claim 12, wherein the waiting time period at the step (a) is adjusted in accordance with a time period including at least the gelating process performed at the step (d).

14. A method for forming a film on the front surface of a substrate, comprising the steps of:

(a) coating a coating solution of which particles of a starting substance of a film forming component have been dispersed in first solvent on the front surface of the substrate so as to form a coated film;

(b) outputting a ready signal when the step (a) is completed; and (c) preparing a gelating process portion, in response to the ready signal, to receive and process the substrate immediately after said coating process is complete, thereby suppressing evaporation of said coating solution.

15. A method for conveying a substrate having a coated film of a coating solution which contains a starting substance of a film forming component and a solvent, the substrate coated by using an apparatus comprising a substrate conveying member for holding and conveying the substrate, a vapor supplying means for supplying a vapor of the component of the solvent to the front surface of the coated film so as to suppress the solvent contained in the coated film from evaporating, a moving base wherein the substrate conveying member has an arm member advanced and retreated to said moving base and the vapor supplying means is disposed on the moving base in such a manner that vapor of the solvent is supplied to the substrate that is held by the arm member when the arm member is retreated, a vessel disposed on said moving base and for housing the arm member and the substrate when the arm member is retreated wherein the vapor supplying means is disposed in the vessel, and means provided on the vessel, for exhausting vapor of the solvent component supplied from said vapor supplying means, comprising the steps of:

holding and conveying the substrate; and supplying vapor of component of the solvent to the front surface of the coated film during said holding and conveying step so as to suppress the solvent of the coated film from evaporating.

* * * * *